US007143755B2

(12) United States Patent
Miyauchi et al.

(10) Patent No.: US 7,143,755 B2
(45) Date of Patent: Dec. 5, 2006

(54) AIR/FUEL RATIO CONTROL SYSTEM FOR OUTBOARD MOTOR ENGINE

(75) Inventors: Tomohiro Miyauchi, Wako (JP); Kazuhiro Sato, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/356,371

(22) Filed: Feb. 16, 2006

(65) Prior Publication Data

US 2006/0185656 A1 Aug. 24, 2006

(30) Foreign Application Priority Data

Feb. 18, 2005 (JP) ..... 2005-042861
Feb. 18, 2005 (JP) ..... 2005-042862

(51) Int. Cl.
*F02D 41/14* (2006.01)

(52) U.S. Cl. ..... 123/674; 701/109

(58) Field of Classification Search ..... 123/674, 123/675; 701/109
See application file for complete search history.

(56) References Cited

U.S. PATENT DOCUMENTS 4,445,481 A * 5/1984 Aoki et al. ..... 123/674
4,498,445 A * 2/1985 Hasegawa et al. ..... 123/674
4,669,439 A * 6/1987 Mamiya et al. ..... 123/674
4,913,122 A * 4/1990 Uchida et al. ..... 123/674
5,704,339 A * 1/1998 Choe et al. ..... 123/674
6,014,962 A * 1/2000 Sato et al. ..... 123/674

FOREIGN PATENT DOCUMENTS

JP 57-105530 7/1982

* cited by examiner

*Primary Examiner*—T. M. Argenbright
(74) *Attorney, Agent, or Firm*—Carrier, Blackman & Associates, P.C.; Joseph P. Carrier; William D. Blackman

(57) ABSTRACT

In an air/fuel ratio control system for an outboard motor engine, a learned correction coefficient KTIMn used in open-loop control for correcting a basic fuel injection amount to be supplied to the engine, is updated only when the manifold absolute pressure PBA (indicative of engine load) is within a predetermined range relative to the engine speed NE concerned. As a result, the air/fuel ratio can be accurately controlled to one other than the stoichiometric air/fuel ratio, even when an $O_2$ sensor that produces an output whose property only changes near the stoichiometeic air/fuel ratio is used.

10 Claims, 15 Drawing Sheets

FIG. 7

| | NKTIM1 | NKTIM2 | NKTIM3 | NKTIM4 | NKTIM5 | NKTIM6 | NKTIM7 | NKTIM8 |
|---|---|---|---|---|---|---|---|---|
| PBKTIM1 | KTIM0 1.0 | KTIM1 1.0 | KTIM2 1.0 | KTIM3 1.0 | KTIM4 1.0 | KTIM5 1.0 | KTIM6 1.0 | KTIM7 1.0 |
| PBKTIM2 | KTIM8 1.0 | KTIM9 1.0 | KTIM10 1.0 | KTIM11 1.0 | KTIM12 1.0 | KTIM13 1.0 | KTIM14 1.0 | KTIM15 1.0 |
| PBKTIM3 | KTIM16 1.0 | KTIM17 1.0 | KTIM18 1.0 | KTIM19 1.0 | KTIM20 1.0 | KTIM21 1.0 | KTIM22 1.0 | KTIM23 1.0 |
| PBKTIM4 | KTIM24 1.0 | KTIM25 1.0 | KTIM26 1.0 | KTIM27 1.0 | KTIM28 1.0 | KTIM29 1.0 | KTIM30 1.0 | KTIM31 1.0 |
| PBKTIM5 | KTIM32 1.0 | KTIM33 1.0 | KTIM34 1.0 | KTIM35 1.0 | KTIM36 1.0 | KTIM37 1.0 | KTIM38 1.0 | KTIM39 1.0 |
| PBKTIM6 | KTIM40 1.0 | KTIM41 1.0 | KTIM42 1.0 | KTIM43 1.0 | KTIM44 1.0 | KTIM45 1.0 | KTIM46 1.0 | KTIM47 1.0 |
| PBKTIM7 | KTIM48 1.0 | KTIM49 1.0 | KTIM50 1.0 | KTIM51 1.0 | KTIM52 1.0 | KTIM53 1.0 | KTIM54 1.0 | KTIM55 1.0 |
| PBKTIM8 | KTIM56 1.0 | KTIM57 1.0 | KTIM58 1.0 | KTIM59 1.0 | KTIM60 1.0 | KTIM61 1.0 | KTIM62 1.0 | KTIM63 1.0 |

PBA

HIGH

NE

HIGH

20c

FIG. 11

UPDATING KTIM

| | NKTIM1 | NKTIM2 | NKTIM3 | NKTIM4 | NKTIM5 | NKTIM6 | NKTIM7 | NKTIM8 |
|---|---|---|---|---|---|---|---|---|
| PBKTIM1 | KTIM0 | KTIM1 | KTIM2 | KTIM3 | KTIM4 | KTIM5 | KTIM6 | KTIM7 |
| | 0.999 | 1.002 | 1.0 | 1.0 | 1.0 | 1.0 | 1.0 | 1.0 |
| PBKTIM2 | KTIM8 | KTIM9 | KTIM10 | KTIM11 | KTIM12 | KTIM13 | KTIM14 | KTIM15 |
| | 1.0 | 1.001 | 0.983 | 1.0 | 1.0 | 1.0 | 1.0 | 1.0 |
| PBKTIM3 | KTIM16 | KTIM17 | KTIM18 | KTIM19 | KTIM20 | KTIM21 | KTIM22 | KTIM23 |
| | 1.0 | 1.0 | 0.980 | 1.0 | 1.0 | 1.0 | 1.0 | 1.0 |
| PBKTIM4 | KTIM24 | KTIM25 | KTIM26 | KTIM27 | KTIM28 | KTIM29 | KTIM30 | KTIM31 |
| | 1.0 | 1.0 | 0.978 | 1.012 | 1.0 | 1.0 | 1.0 | 1.0 |
| PBKTIM5 | KTIM32 | KTIM33 | KTIM34 | KTIM35 | KTIM36 | KTIM37 | KTIM38 | KTIM39 |
| | 1.0 | 1.0 | 1.0 | 1.0 | 1.0 | 1.0 | 1.0 | 1.0 |
| PBKTIM6 | KTIM40 | KTIM41 | KTIM42 | KTIM43 | KTIM44 | KTIM45 | KTIM46 | KTIM47 |
| | 1.0 | 1.0 | 1.0 | 1.0 | 1.0 | 1.0 | 1.0 | 1.0 |
| PBKTIM7 | KTIM48 | KTIM49 | KTIM50 | KTIM51 | KTIM52 | KTIM53 | KTIM54 | KTIM55 |
| | 1.0 | 1.0 | 1.0 | 1.0 | 1.0 | 1.0 | 1.0 | 1.0 |
| PBKTIM8 | KTIM56 | KTIM57 | KTIM58 | KTIM59 | KTIM60 | KTIM61 | KTIM62 | KTIM63 |
| | 1.0 | 1.0 | 1.0 | 1.0 | 1.0 | 1.0 | 1.0 | 1.0 |
| F.NKTIMm | 0 | 0 | 0 | 0 | 0 | 0 | 0 | 0 |

| KTMRSTR1 | KTMRSTR2 | KTMRSTR3 | KTMRSTR4 | KTMRSTR5 | KTMRSTR6 | KTMRSTR7 | KTMRSTR8 |
|---|---|---|---|---|---|---|---|
| 1.0 | 1.0 | 1.0 | 1.0 | 1.0 | 1.0 | 1.0 | 1.0 |

FIG. 12

F. SLBREFOK←1

| | NKTIM1 | NKTIM2 | NKTIM3 | NKTIM4 | NKTIM5 | NKTIM6 | NKTIM7 | NKTIM8 |
|---|---|---|---|---|---|---|---|---|
| PBKTIM1 | KTIM0 | KTIM1 | KTIM2 | KTIM3 | KTIM4 | KTIM5 | KTIM6 | KTIM7 |
| | 0.999 | 1.002 | 1.0 | 1.0 | 1.0 | 1.0 | 1.0 | 1.0 |
| PBKTIM2 | KTIM8 | KTIM9 | KTIM10 | KTIM11 | KTIM12 | KTIM13 | KTIM14 | KTIM15 |
| | 1.0 | 1.001 | 0.983 | 1.0 | 1.0 | 1.0 | 1.0 | 1.0 |
| PBKTIM3 | KTIM16 | KTIM17 | KTIM18 | KTIM19 | KTIM20 | KTIM21 | KTIM22 | KTIM23 |
| | 1.0 | 1.0 | 0.980 | 1.0 | 1.0 | 1.0 | 1.0 | 1.0 |
| PBKTIM4 | KTIM24 | KTIM25 | KTIM26 | KTIM27 | KTIM28 | KTIM29 | KTIM30 | KTIM31 |
| | 1.0 | 1.0 | 0.978 | 1.015 | 1.0 | 1.0 | 1.0 | 1.0 |
| PBKTIM5 | KTIM32 | KTIM33 | KTIM34 | KTIM35 | KTIM36 | KTIM37 | KTIM38 | KTIM39 |
| | 1.0 | 1.0 | 1.0 | 1.0 | 1.0 | 1.0 | 1.0 | 1.0 |
| PBKTIM6 | KTIM40 | KTIM41 | KTIM42 | KTIM43 | KTIM44 | KTIM45 | KTIM46 | KTIM47 |
| | 1.0 | 1.0 | 1.0 | 1.0 | 1.0 | 1.0 | 1.0 | 1.0 |
| PBKTIM7 | KTIM48 | KTIM49 | KTIM50 | KTIM51 | KTIM52 | KTIM53 | KTIM54 | KTIM55 |
| | 1.0 | 1.0 | 1.0 | 1.0 | 1.0 | 1.0 | 1.0 | 1.0 |
| PBKTIM8 | KTIM56 | KTIM57 | KTIM58 | KTIM59 | KTIM60 | KTIM61 | KTIM62 | KTIM63 |
| | 1.0 | 1.0 | 1.0 | 1.0 | 1.0 | 1.0 | 1.0 | 1.0 |

| | | | | | | | | |
|---|---|---|---|---|---|---|---|---|
| F. NKTIMm | 0 | 0 | 0 | 1 | 0 | 0 | 0 | 0 |

| KTMRSTR1 | KTMRSTR2 | KTMRSTR3 | KTMRSTR4 | KTMRSTR5 | KTMRSTR6 | KTMRSTR7 | KTMRSTR8 |
|---|---|---|---|---|---|---|---|
| 1.0 | 1.0 | 1.0 | 1.015 | 1.0 | 1.0 | 1.0 | 1.0 |

FIG. 13

| | NKTIM1 | NKTIM2 | NKTIM3 | NKTIM4 | NKTIM5 | NKTIM6 | NKTIM7 | NKTIM8 |
|---|---|---|---|---|---|---|---|---|
| PBKTIM1 | KTIM0 | KTIM1 | KTIM2 | KTIM3 | KTIM4 | KTIM5 | KTIM6 | KTIM7 |
| | 0.999 | 1.002 | 1.0 | 1.0 | 1.0 | 1.0 | 1.0 | 1.0 |
| PBKTIM2 | KTIM8 | KTIM9 | KTIM10 | KTIM11 | KTIM12 | KTIM13 | KTIM14 | KTIM15 |
| | 1.0 | 1.001 | 0.983 | 1.0 | 1.0 | 1.0 | 1.0 | 1.0 |
| PBKTIM3 | KTIM16 | KTIM17 | KTIM18 | KTIM19 | KTIM20 | KTIM21 | KTIM22 | KTIM23 |
| | 1.0 | 1.0 | 0.980 | 1.015 | 1.0 | 1.0 | 1.0 | 1.0 |
| PBKTIM4 | KTIM24 | KTIM25 | KTIM26 | KTIM27 | KTIM28 | KTIM29 | KTIM30 | KTIM31 |
| | 1.0 | 1.0 | 0.978 | 1.015 | 1.0 | 1.0 | 1.0 | 1.0 |
| PBKTIM5 | KTIM32 | KTIM33 | KTIM34 | KTIM35 | KTIM36 | KTIM37 | KTIM38 | KTIM39 |
| | 1.0 | 1.0 | 1.0 | 1.015 | 1.0 | 1.0 | 1.0 | 1.0 |
| PBKTIM6 | KTIM40 | KTIM41 | KTIM42 | KTIM43 | KTIM44 | KTIM45 | KTIM46 | KTIM47 |
| | 1.0 | 1.0 | 1.0 | 1.0 | 1.0 | 1.0 | 1.0 | 1.0 |
| PBKTIM7 | KTIM48 | KTIM49 | KTIM50 | KTIM51 | KTIM52 | KTIM53 | KTIM54 | KTIM55 |
| | 1.0 | 1.0 | 1.0 | 1.0 | 1.0 | 1.0 | 1.0 | 1.0 |
| PBKTIM8 | KTIM56 | KTIM57 | KTIM58 | KTIM59 | KTIM60 | KTIM61 | KTIM62 | KTIM63 |
| | 1.0 | 1.0 | 1.0 | 1.0 | 1.0 | 1.0 | 1.0 | 1.0 |
| F.NKTIMm | 0 | 0 | 0 | 1 | 0 | 0 | 0 | 0 |

| KTMRSTR1 | KTMRSTR2 | KTMRSTR3 | KTMRSTR4 | KTMRSTR5 | KTMRSTR6 | KTMRSTR7 | KTMRSTR8 |
|---|---|---|---|---|---|---|---|
| 1.0 | 1.0 | 1.0 | 1.015 | 1.0 | 1.0 | 1.0 | 1.0 |

FIG. 15

F. SLBREFOK←0

| | NKTIM1 | NKTIM2 | NKTIM3 | NKTIM4 | NKTIM5 | NKTIM6 | NKTIM7 | NKTIM8 |
|---|---|---|---|---|---|---|---|---|
| PBKTIM1 | KTIM0 | KTIM1 | KTIM2 | KTIM3 | KTIM4 | KTIM5 | KTIM6 | KTIM7 |
| | 0.999 | 1.002 | 1.0 | 1.0 | 1.0 | 1.0 | 1.0 | 1.0 |
| PBKTIM2 | KTIM8 | KTIM9 | KTIM10 | KTIM11 | KTIM12 | KTIM13 | KTIM14 | KTIM15 |
| | 1.0 | 1.001 | 0.983 | 1.0 | 1.0 | 1.0 | 1.0 | 1.0 |
| PBKTIM3 | KTIM16 | KTIM17 | KTIM18 | KTIM19 | KTIM20 | KTIM21 | KTIM22 | KTIM23 |
| | 1.0 | 1.0 | 0.980 | 1.015 | 1.0 | 1.0 | 1.0 | 1.0 |
| PBKTIM4 | KTIM24 | KTIM25 | KTIM26 | KTIM27 | KTIM28 | KTIM29 | KTIM30 | KTIM31 |
| | 1.0 | 1.0 | 0.978 | 1.015 | 1.0 | 1.0 | 1.0 | 1.0 |
| PBKTIM5 | KTIM32 | KTIM33 | KTIM34 | KTIM35 | KTIM36 | KTIM37 | KTIM38 | KTIM39 |
| | 1.0 | 1.0 | 1.0 | 1.015 | 1.0 | 1.0 | 1.0 | 1.0 |
| PBKTIM6 | KTIM40 | KTIM41 | KTIM42 | KTIM43 | KTIM44 | KTIM45 | KTIM46 | KTIM47 |
| | 1.0 | 1.0 | 1.0 | 1.0 | 1.0 | 1.0 | 1.0 | 1.0 |
| PBKTIM7 | KTIM48 | KTIM49 | KTIM50 | KTIM51 | KTIM52 | KTIM53 | KTIM54 | KTIM55 |
| | 1.0 | 1.0 | 1.0 | 1.0 | 1.0 | 1.0 | 1.0 | 1.0 |
| PBKTIM8 | KTIM56 | KTIM57 | KTIM58 | KTIM59 | KTIM60 | KTIM61 | KTIM62 | KTIM63 |
| | 1.0 | 1.0 | 1.0 | 1.0 | 1.0 | 1.0 | 1.0 | 1.0 |
| F. NKTIMm | 0 | 0 | 0 | 1 | 0 | 0 | 0 | 0 |

| KTMRSTR1 | KTMRSTR2 | KTMRSTR3 | KTMRSTR4 | KTMRSTR5 | KTMRSTR6 | KTMRSTR7 | KTMRSTR8 |
|---|---|---|---|---|---|---|---|
| 1.0 | 1.0 | 1.0 | 1.015 | 1.0 | 1.0 | 1.0 | 1.0 |

FIG. 16

F. SLBREFOK←1

| | NKTIM1 | NKTIM2 | NKTIM3 | NKTIM4 | NKTIM5 | NKTIM6 | NKTIM7 | NKTIM8 |
|---|---|---|---|---|---|---|---|---|
| PBKTIM1 | KTIM0 | KTIM1 | KTIM2 | KTIM3 | KTIM4 | KTIM5 | KTIM6 | KTIM7 |
| | 0.999 | 1.002 | 1.0 | 1.0 | 1.0 | 1.0 | 1.0 | 1.0 |
| PBKTIM2 | KTIM8 | KTIM9 | KTIM10 | KTIM11 | KTIM12 | KTIM13 | KTIM14 | KTIM15 |
| | 1.0 | 1.001 | 0.983 | 1.0 | 1.0 | 1.0 | 1.0 | 1.0 |
| PBKTIM3 | KTIM16 | KTIM17 | KTIM18 | KTIM19 | KTIM20 | KTIM21 | KTIM22 | KTIM23 |
| | 1.0 | 1.0 | 0.980 | 1.015 | 1.0 | 1.0 | 1.0 | 1.0 |
| PBKTIM4 | KTIM24 | KTIM25 | KTIM26 | KTIM27 | KTIM28 | KTIM29 | KTIM30 | KTIM31 |
| | 1.0 | 1.0 | 0.978 | 1.015 | 1.024 | 1.0 | 1.0 | 1.0 |
| PBKTIM5 | KTIM32 | KTIM33 | KTIM34 | KTIM35 | KTIM36 | KTIM37 | KTIM38 | KTIM39 |
| | 1.0 | 1.0 | 1.0 | 1.015 | 1.0 | 1.0 | 1.0 | 1.0 |
| PBKTIM6 | KTIM40 | KTIM41 | KTIM42 | KTIM43 | KTIM44 | KTIM45 | KTIM46 | KTIM47 |
| | 1.0 | 1.0 | 1.0 | 1.0 | 1.0 | 1.0 | 1.0 | 1.0 |
| PBKTIM7 | KTIM48 | KTIM49 | KTIM50 | KTIM51 | KTIM52 | KTIM53 | KTIM54 | KTIM55 |
| | 1.0 | 1.0 | 1.0 | 1.0 | 1.0 | 1.0 | 1.0 | 1.0 |
| PBKTIM8 | KTIM56 | KTIM57 | KTIM58 | KTIM59 | KTIM60 | KTIM61 | KTIM62 | KTIM63 |
| | 1.0 | 1.0 | 1.0 | 1.0 | 1.0 | 1.0 | 1.0 | 1.0 |

| | | | | | | | | |
|---|---|---|---|---|---|---|---|---|
| F. NKTIMm | 0 | 0 | 0 | 1 | 1 | 0 | 0 | 0 |

| KTMRSTR1 | KTMRSTR2 | KTMRSTR3 | KTMRSTR4 | KTMRSTR5 | KTMRSTR6 | KTMRSTR7 | KTMRSTR8 |
|---|---|---|---|---|---|---|---|
| 1.0 | 1.0 | 1.0 | 1.015 | 1.024 | 1.0 | 1.0 | 1.0 |

AIR/FUEL RATIO CONTROL SYSTEM FOR OUTBOARD MOTOR ENGINE

BACKGROUND OF THE INVENTION

1. Field of the Invention

This invention relates to an air/fuel ratio control system for an outboard motor internal combustion engine.

2. Description of the Related Art

Feedback control of the air/fuel ratio of an internal combustion engine using an $O_2$ sensor (oxygen sensor or air/fuel ratio sensor) installed in the exhaust system is known to the prior art. This type of control utilizes a characteristic of the $O_2$ sensor whereby the sensor produces an output whose property only changes near the stoichiometric air/fuel ratio. Feedback control is therefore not possible when the desired air/fuel ratio is not the stoichiometric air/fuel ratio. The practice has therefore been to calculate a learned correction coefficient from the feedback correction coefficient used by the feedback control and correct the basic fuel injection quantity using the learned correction coefficient when the desired air/fuel ratio is not the stoichiometric air/fuel ratio, thereby controlling, i.e., open-loop controlling the air/fuel ratio to one other than the stoichiometric air/fuel ratio, as taught, for example, in Japanese Laid-Open Patent Application No. Sho 57(1982)-105530.) It is also known to control the air/fuel ratio using a universal air/fuel ratio sensor that produces linear outputs proportional to the air/fuel ratio in a wider range.

If such a universal air/fuel ratio sensor is used, since it becomes possible to calculate the correction coefficient at a time when the desired air/fuel ratio is set to one other than the stoichiometric air/fuel ratio, the air/fuel ratio can be controlled more precisely than a case where the $O_2$ sensor is used. However, since the universal sensor is more expensive than the $O_2$ sensor, this is disadvantageous from the viewpoint of cost.

SUMMARY OF THE INVENTION

An object of this invention is therefore to overcome the foregoing problem by providing an air/fuel ratio control system for an outboard motor engine that enables to accurately control the air/fuel ratio to one other than the stoichiometric air/fuel ratio even when using a sensor whose output property only changes near the stoichiometric air/fuel ratio.

In order to achieve the object, this invention provides a system for controlling an air/fuel ratio of an internal combustion engine mounted on an outboard motor, comprising: detectors detecting operational state of the engine including an engine speed and engine load; an oxygen sensor disposed at an exhaust system of the engine and producing an output whose property changes near a stoichiometric air/fuel ratio; a first controller controlling the air/fuel ratio of the engine to the stoichiometric air/fuel ratio by correcting a basic fuel injection quantity to be supplied to the engine determined based on the detected operational state of the engine, by a feedback correction coefficient determined based on the output of the oxygen sensor; a memory having a plurality of storage areas divided by the engine speed and engine load and each storing a learned correction coefficient that is used for correcting the basic fuel injection quantity; a learned correction coefficient calculator calculating the learned correction coefficient based on the feedback correction coefficient; a learned correction coefficient updater updating the learned correction coefficient by writing the calculated learned correction coefficient over the stored learned correction coefficient, when the engine load is within a predetermined range relative to the engine speed; and a second controller retrieving the learned correction coefficient from the engine speed and engine load and controlling the air/fuel ratio to one other than the stoichiometric air/fuel ratio by correcting the basic fuel injection quantity by at least the retrieved learned correction coefficient.

BRIEF DESCRIPTION OF THE DRAWINGS

The above and other objects and advantages of the invention will be more apparent from the following description and drawings in which:

FIG 7 is an explanatory diagram showing the learned correction coefficient mapped data used in the flowchart of FIG. 4;

FIG 11 is an explanatory diagram showing the learned correction coefficient mapped data, stored value mapped data and the like used in the flowchart of FIG. 4;

FIG 12 is an explanatory diagram similarly showing the learned correction coefficient mapped data, stored value mapped data and the like;

FIG 13 is an explanatory diagram similarly showing the learned correction coefficient mapped data, stored value mapped data and the like;

FIG 15 is an explanatory diagram similar to FIG. 11 etc. showing the learned correction coefficient mapped data, stored value mapped data and the like; and FIG 16 is an explanatory diagram similarly showing the learned correction coefficient mapped data, stored value mapped data and the like.

DETAILED DESCRIPTION OF THE PREFERRED EMBODIMENT

An air/fuel ratio control system for an outboard motor engine according to an embodiment of the present invention will now be explained with reference to the attached drawings.

Figure 1:
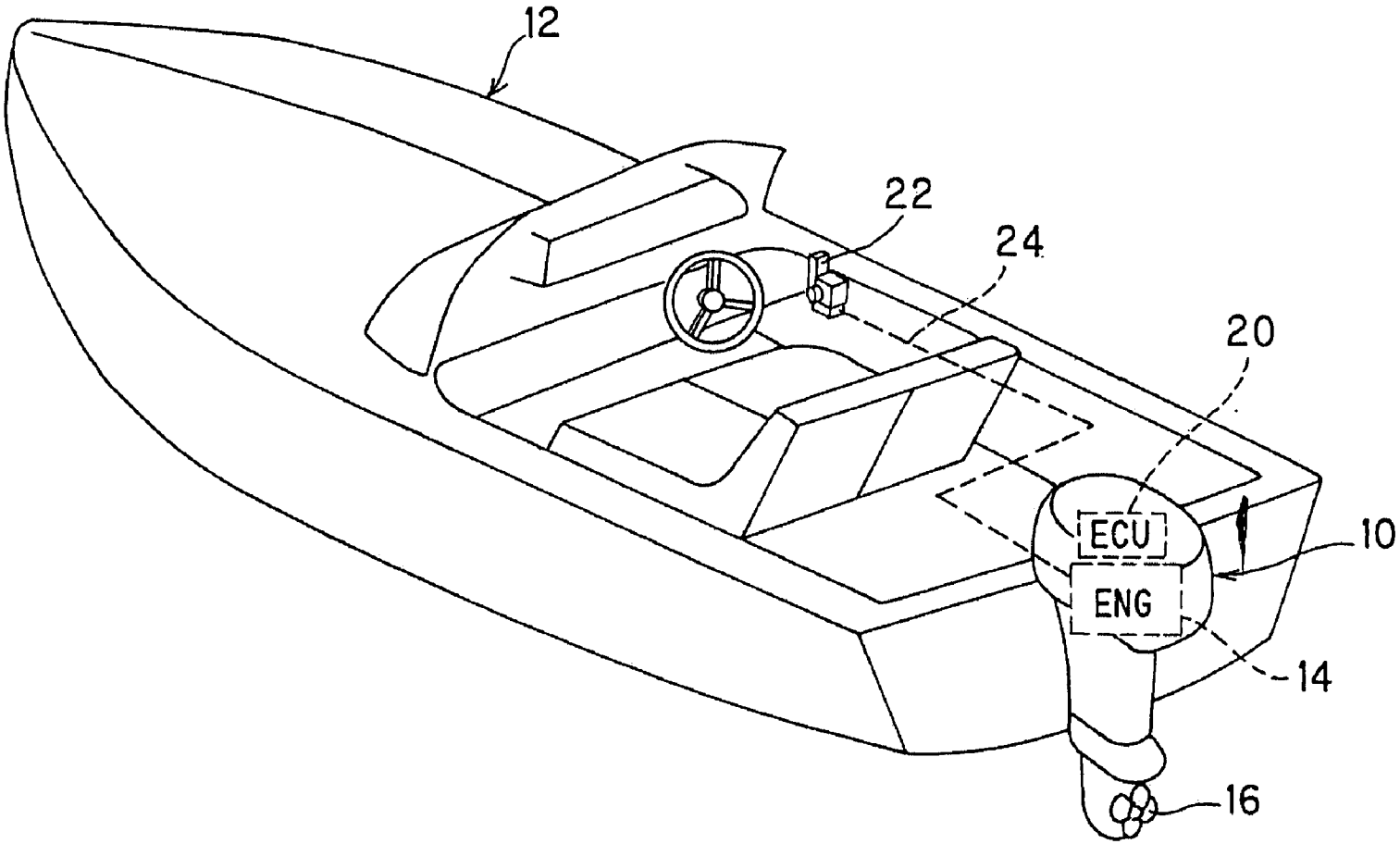
FIG. 1 is a perspective view showing an outboard motor equipped with an air/fuel ratio control system for an outboard motor engine according to this invention along with the boat on which the outboard motor is mounted.

FIG 1 is a perspective view showing an outboard motor equipped with an air/fuel ratio control system for an outboard motor engine according to this invention along with the boat on which the outboard motor is mounted.

The symbol 10 in FIG. 1 designates the outboard motor. As illustrated, the outboard motor 10 is mounted on the stem of a boat (hull) 12.

An internal combustion engine 14 is installed in the upper part of the outboard motor 10. The engine 14 is a multiple cylinder, spark-ignition, gasoline engine. A propeller 16 is installed in the lower part of the outboard motor 10. The propeller 16 is rotated by the power of the engine 14 transmitted through a shift mechanism (explained later) and other mechanisms to propel the boat 12 in the forward or reverse direction.

An electronic control unit (ECU) 20 is installed near the engine 14. The ECU 20 comprises a microcomputer. It controls the air/fuel ratio and the like of the engine 14 based on the outputs of sensors to be explained later.

A throttle lever 22 that can be swung to a desired position by the boat operator is installed near the operator's seat of the boat 12. The throttle lever 22 is connected via a push-pull cable 24 to the throttle valve (not shown in FIG. 1) of the engine 14. Although the boat 12 is also equipped with, inter alia, a shift lever for operating the shift mechanism of the outboard motor 10 and switches for inputting tilt and trim angle adjustment commands to the outboard motor 10, these members are omitted in the drawings because they are not directly related to the substance of this invention.

Figure 2:
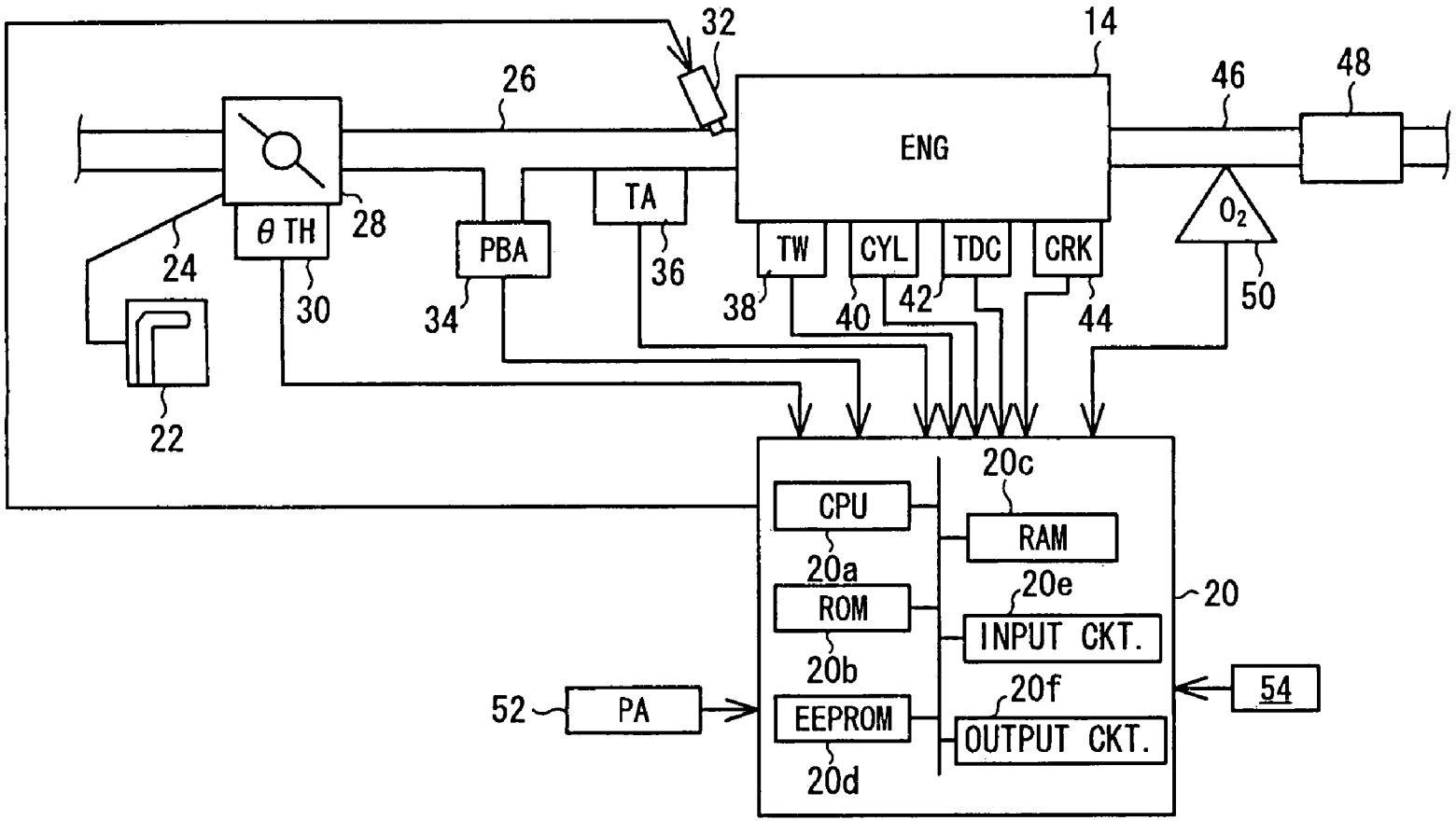
FIG. 2 is a schematic view showing an ECU and the engine shown in FIG. 1.

FIG. 2 is a schematic drawing showing the ECU 20 of the engine 14 shown in FIG. 1.

As shown in FIG. 2, a throttle valve 28 is disposed at the upstream end of an air intake pipe 26 of the engine 14. As explained earlier, the throttle valve 28 is connected through the push-pull cable 24 to the throttle lever 22 mounted on the boat (not shown in FIG. 2). The opening of the throttle valve 28 varies in proportion to the amount of manipulation of the throttle lever 22 to regulate the air intake of the engine 14. A throttle position sensor 30 provided near the throttle valve 28 produces an output or signal indicative of the throttle opening θTH.

Each cylinder of the engine 14 is provided with a fuel injector 32 near the intake port thereof located immediately following an intake manifold (not shown) at the downstream end of the throttle valve 28. The injectors 32 are supplied with pressurized gasoline from a fuel tank (not shown) through a fuel pump and a fuel line. The valve open time of the injectors 32 is controlled by a control signal from the ECU 20.

A manifold absolute pressure sensor 34 and an intake air temperature sensor 36 disposed in the air intake pipe 26 downstream of the throttle valve 28 produce outputs or signals indicative of the manifold absolute pressure PBA of the intake manifold (indicative of the engine load) and the intake air temperature TA. A coolant temperature sensor 38 mounted on a jacket (not shown) enclosing the cylinders produces an output or signal indicative of the engine coolant temperature TW, namely the temperature of the cylinder block coolant of the engine 14 filling the jacket.

A cylinder identification sensor 40 installed near the crankshaft (not shown) of the engine 14 outputs a cylinder identification signal CYL when the crankangle at a specified cylinder reaches a predetermined value. A TDC sensor 42 and a crankangle sensor 44 are also installed near the crankshaft of the engine 14. The TDC sensor 42 outputs TDC signals at crankangles associated with the TDC (top dead center) positions of the pistons at the respective cylinders. The crankangle sensor 44 outputs CRK signals at a shorter crankangle period (e.g., every 30 degrees) than the period of the TDC signals.

An $O_2$ sensor (oxygen sensor or air/fuel ratio sensor) 50 is provided in the exhaust system of the engine 14 at a point upstream of a three-way catalytic converter 48 provided in an exhaust pipe 46. The $O_2$ sensor 50 produces an output whose property only changes near the stoichiometric air/fuel ratio. To be specific, the output voltage of the $O_2$ sensor 50 changes abruptly near the stoichiometric air/fuel ratio. Whether the air/fuel ratio is lean or rich relative to the stoichiometric air/fuel ratio can therefore be discriminated by comparing the output voltage of the $O_2$ sensor 50 with a reference voltage indicative of the stoichiometric air/fuel ratio. An atmospheric pressure sensor 52 is installed at a suitable location near the engine 14. The atmospheric pressure sensor 52 produces an output or signal indicative of the atmospheric pressure PA.

The outputs of the aforesaid sensors are sent to the ECU 20. The ECU 20 is equipped with a CPU 20*a* that performs computations for controlling different parts of the engine 14, a ROM 20*b* that stores various programs and data used to control different parts of the engine 14, a RAM 20*c* for storing sensor outputs, learned correction coefficients (explained later) calculated by the CPU 20*a* and other data, and an EEPROM (Electrically Programmable Read Only Memory) 20*d*, which is a nonvolatile memory that also stores the learned correction coefficients, an input circuit 20*e* for inputting signals received from the sensors, and an output circuit 20*f* for sending control signals to the different parts of the engine 14.

The input circuit 20*e* waveforms the input signals, corrects their voltage to a predetermined voltage level and converts their signal values from analog to digital. The CPU 20*a* processes the digitized signals, executes computations in accordance with a program stored in the ROM 20*b*, and sends control signals to the injectors 32 and other actuators (not shown) through the output circuit 20*f*. The ECU 20 includes a counter (not shown) for detecting (determining) the engine speed NE by counting the received CRK signal pulses.

An ignition switch 54 is provided at a suitable location on the outboard motor 10 or boat 12. The ignition switch 54 has Off, On and Start positions arranged in this order. The supply of electric power to different components is enabled and disabled in accordance with the position selected by the operator. Specifically, supply of power to the ECU 20, injectors 32, sensors and the like is cut off completely when the Off position is selected. When the On position is selected, power is supplied to the ECU 20, injectors 32, sensors and other components other than the self-starter motor (not shown). When the ignition switch 54 is turned through the On position to select the Start position, the self-starter motor is supplied with power and operated to initiate cranking, thereby starting the engine 14.

The control of the engine 14 executed in the CPU 20, particularly the air/fuel ratio control, will now be explained with reference to FIG. 3 and the ensuing figures.

Figure 3:
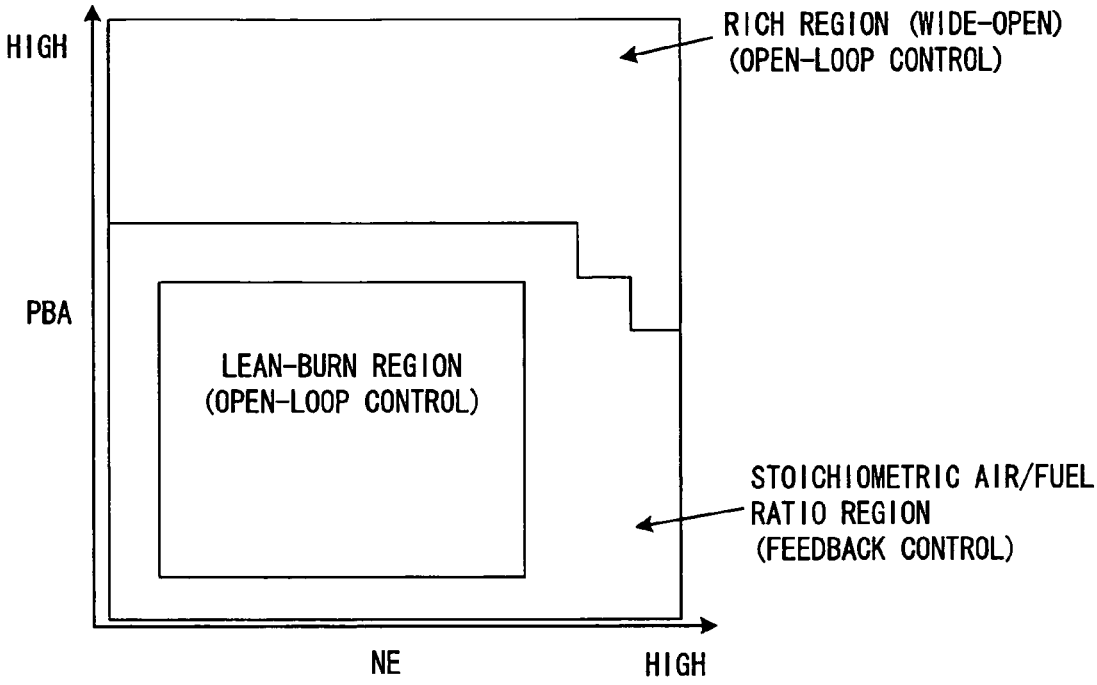
FIG. 3 is an explanatory diagram showing an overview of the air/fuel ratio control performed by the ECU.

FIG. 3 is an explanatory diagram giving an overview of the air/fuel ratio control performed by the ECU 20.

As shown in FIG. 3, lean-burn control (in open-loop control) is performed when the engine speed NE is in the low-to-medium region and the manifold absolute pressure PBA (engine load) is low-to-medium.

The air/fuel ratio is feedback-controlled to the stoichiometric air/fuel ratio in the very low load, very low speed region, such as when the engine 14 is idling, and in the high load, high speed region above the lean-burn region (designated the stoichiometric air/fuel ratio region in the drawing). In the region where the load is higher than that in the stoichiometric air/fuel ratio region, the air/fuel ratio is open-loop controlled.

The air/fuel ratio is controlled by regulating the fuel injection quantity Tout (more exactly, the valve open time of the injectors 32). The fuel injection quantity Tout is calculated as follows:

Fuel injection quantity *T*out=Basic fuel injection quantity *Ti*×Feedback correction coefficient $KO_2$×Learned correction coefficient *KTIM*×Ambient correction term×Desired equivalence ratio *KCMD*

The basic fuel injection quantity Ti is determined by retrieval from predefined mapped data using the engine speed NE and manifold absolute pressure PBA as address data. The feedback correction coefficient $KO_2$ is calculated from the output for the $O_2$ sensor 50. Specifically, the output voltage of the $O_2$ sensor 50 and the reference voltage indicative of the stoichiometric air/fuel ratio are compared to determine whether the current air/fuel ratio is lean or rich, and the feedback correction coefficient $KO_2$ is incrementally reduced when it is rich and incrementally increased when it is lean.

As will explained in further detail later, the learned correction coefficient KTIM is calculated from the feedback correction coefficient $KO_2$ output while feedback control is being conducted. The ambient correction term is calculated from data including the temperature TA, engine coolant temperature TW and atmospheric pressure PA. The desired equivalence ratio KCMD is a value corresponding to the desired air/fuel ratio that is determined from the engine speed NE and manifold absolute pressure PBA.

During feedback control, the learned correction coefficient KTIM is fixed at 1.0 and the desired equivalence ratio KCMD is fixed at the value indicative of the stoichiometric air/fuel ratio. During lean-burn control, the feedback correction coefficient $KO_2$ is fixed at 1.0. When open-loop control is being conducted during high-load operation, the feedback correction coefficient $KO_2$ and learned correction coefficient KTIM are both made 1.0 and acceleration quantity increase correction is performed separately from the foregoing.

The characterizing feature of the air/fuel ratio control system for an outboard motor engine according to this invention is the aforesaid lean-burn control. This control is explained in the following.

Figure 4:
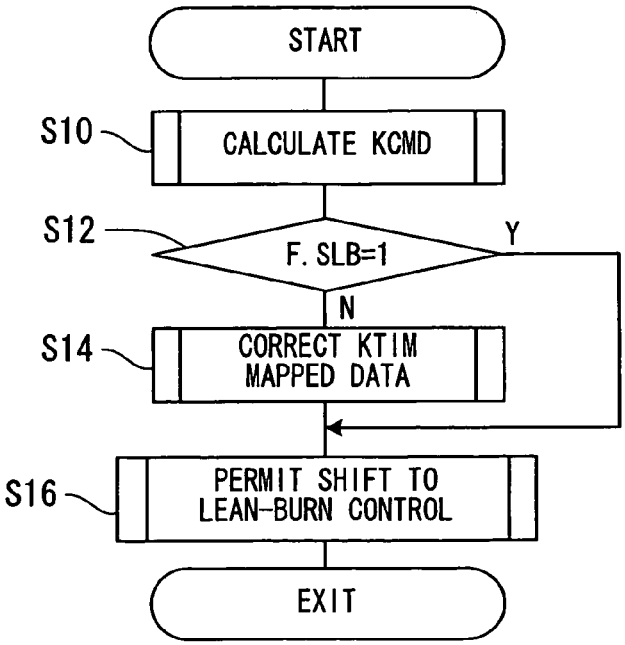
FIG 4 is a main routine flowchart showing a lean-burn control processing conducted by the ECU shown in FIG. 1.

FIG. 4 is a main routine flowchart showing the lean-burn control processing conducted by the ECU 20. The ECU 20 executes this routine at predetermined time intervals of, say, 10 msec.

First, in S10, the desired equivalence ratio KCMD is calculated.

Figure 5:
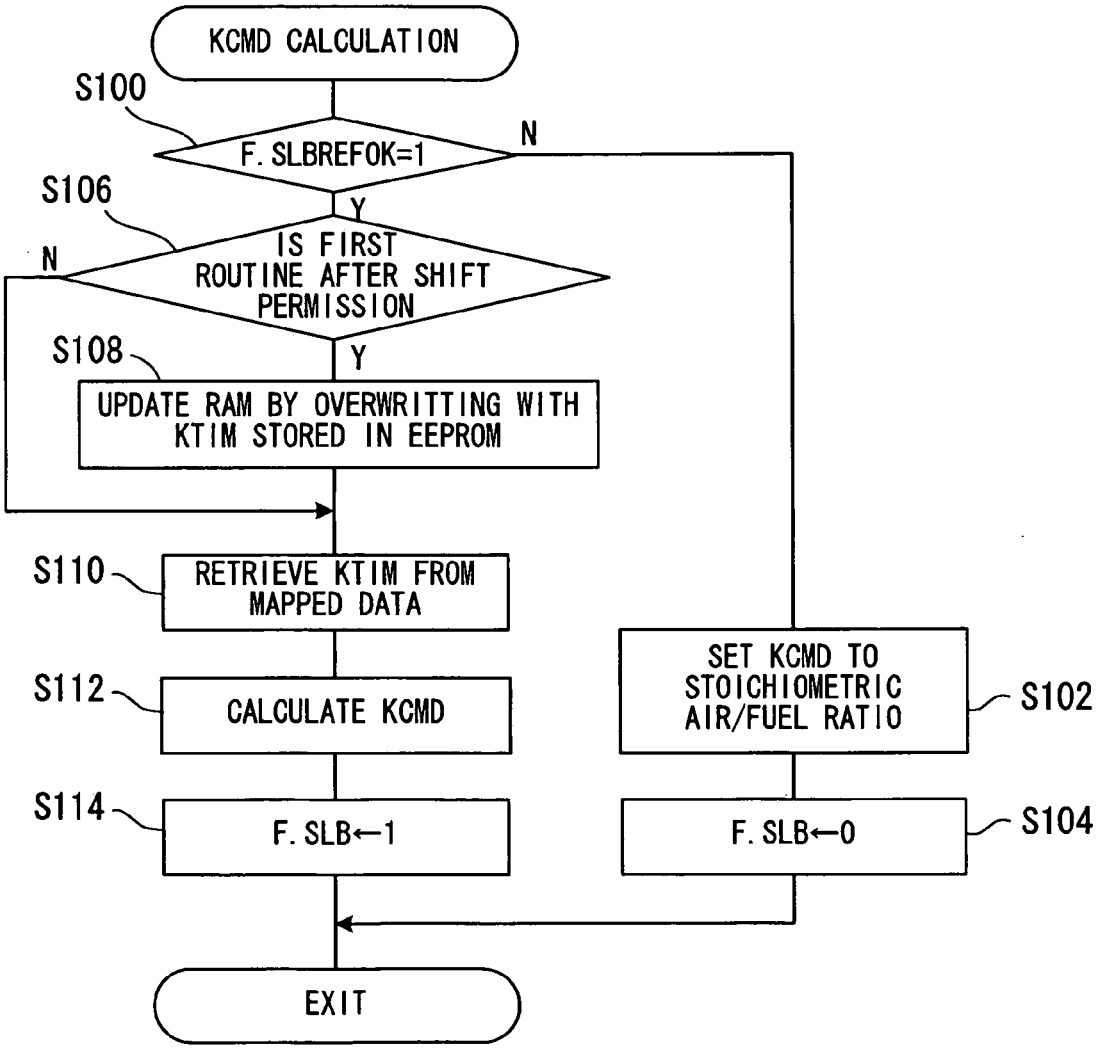
FIG 5 is a subroutine flowchart showing the processing conducted to calculate a desired equivalence ratio in the flowchart of FIG. 4.

FIG 5 is a subroutine flowchart showing the processing conducted to calculate the desired equivalence ratio KCMD.

First, in S100, it is determined whether the bit of a lean-burn control enabled flag F.SLBREFOK is set to 1. The bit of the lean-burn control enabled flag F.SLBREFOK (initially 0) being set to 1 indicates that it is permissible to shift to lean-burn control, i.e., to execute lean-burn control.

When the result in S100 is NO, the subroutine goes to S102, in which the desired equivalence ratio KCMD is set to the value indicative of the stoichiometric air/fuel ratio (14.7). Next, in S104, the bit of a lean-burn in effect flag F.SLB is reset to 0. The bit of the lean-burn in effect flag F.SLB (initially 0) being set to 1 indicates that lean-burn control is being conducted. The desired equivalence ratio KCMD set in S102 is used to calculate the fuel injection quantity Tout during feedback control or high-load open-loop control.

When the result in S100 is YES, the subroutine goes to S106, in which it is determined whether this is the first execution of the subroutine after shift to lean-burn control was enabled. When the result in S106 is YES, the subroutine goes to S108, in which the learned correction coefficient mapped data stored in the RAM 20*c* is updated by overwriting it with the learned correction coefficient KTIM stored in the EEPROM 20*d*. The learned correction coefficient KTIM stored in the RAM 20*c* and EEPROM 20*d* will be explained in detail later. When the result in S106 is NO, S108 is skipped.

Next, in S110, the operational state of the engine 14 is used to retrieve the learned correction coefficient KTIM from the learned correction coefficient mapped data. This will be explained in detail later. Next, in S112, the desired equivalence ratio KCMD is calculated. Specifically, the engine speed NE and manifold absolute pressure PBA are used to retrieve a desired convergence value KBS from mapped data prepared beforehand and the value of the desired equivalence ratio KCMD is incrementally changed to converge it on the determined desired convergence value KBS. The learned correction coefficient KTIM determined S110 and the desired equivalence ratio KCMD calculated in S112 are used to calculate the fuel injection quantity Tout in lean-burn control. Therefore, the desired equivalence ratio KCMD calculated in S112 is set to a value indicative of an air/fuel ratio leaner than the stoichiometric air/fuel ratio. Next, in S114, the bit of the lean-burn in effect flag F.SLB is set to 1.

Next, in S12 of the flowchart of FIG. 4, it is determined whether the bit of the lean-burn in effect flag F.SLB is set to 1, i.e., whether lean-burn control is in effect. When the result in S12 is NO, the routine goes to S14, in which the learned correction coefficient mapped data is corrected.

Figure 6:
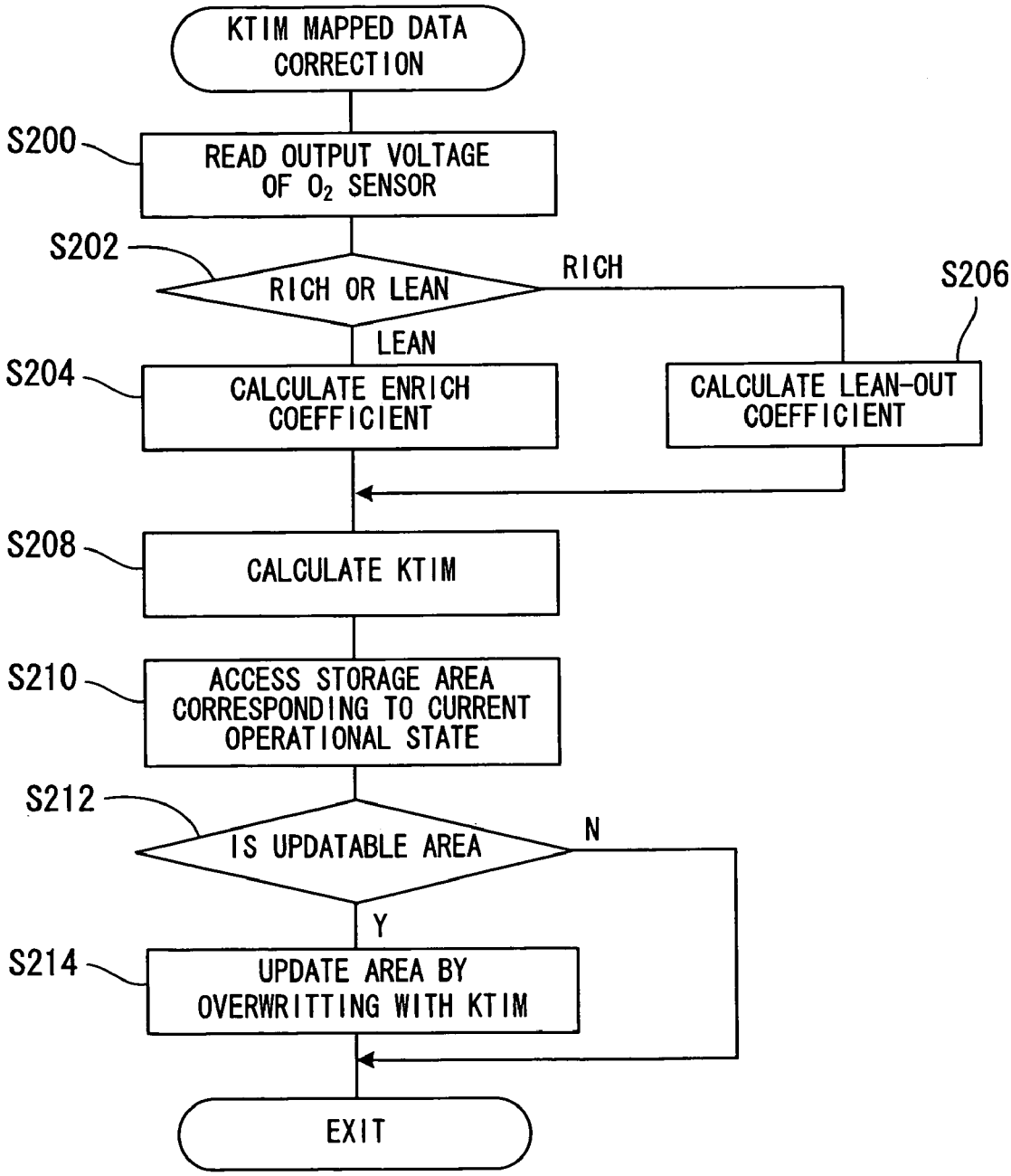
FIG 6 is a subroutine flowchart showing the processing conducted to correct the learned correction coefficient mapped data in the flowchart of FIG. 4.

FIG 6 is a subroutine flowchart showing the processing conducted to correct the learned correction coefficient mapped data.

First, in S200, the output voltage of the $O_2$ sensor 50 is read. Next, in S202, the output voltage of the $O_2$ sensor 50 read in S200 is compared with the reference voltage indicative of the stoichiometric air/fuel ratio to determine whether the current air/fuel ratio is lean or rich relative to the stoichiometric air/fuel ratio. When the current air/fuel ratio is found to be lean in S202, the subroutine goes to S204, in which an enrich coefficient is calculated, and when it is found to be rich, the subroutine goes to S206, in which a lean-out coefficient is calculated. The enrich coefficient and lean-out coefficient are an addition term and a subtraction term determined in accordance with the degree of leanness and richness.

Next, in S208, the learned correction coefficient KTIM is calculated. The learned correction coefficient KTIM is incrementally increased or decreased using the enrich coefficient or the lean-out coefficient so as to approach the feedback correction coefficient $KO_2$ utilized in feedback control. The learned correction coefficient KTIM calculated in S208 is calculated as the average value of KTIM during a predetermined time period.

Next, in S210, the storage area of the learned correction coefficient mapped data corresponding to the current operational state is accessed.

FIG 7 is an explanatory diagram showing the learned correction coefficient mapped data stored in the RAM 20*c*.

As shown in FIG. 7, the learned correction coefficient mapped data is composed of multiple storage areas divided according to the values of the engine speed NE and manifold absolute pressure PBA (engine load). Specifically, the mapped data is divided into 8 columns each associated with a different range of engine speeds NE and 8 rows each associated with a different range of manifold absolute pressures PBA, thereby forming a total of 64 storage areas. A learned correction coefficient KTIM is stored in each storage area. In the following, the learned correction coefficient KTIM will sometimes be represented as "KTIMn" (n: integer between 0 and 63).

The 8 columns divided in accordance with the magnitude of the engine speed NE will be represented as "NKTIMm" (m: integer between 1 and 8) and the 8 rows divided in accordance with the magnitude of the manifold absolute pressure PBA will be represented as "PBKTIMm" (m: integer between 1 and 8). The columns NKTIMm represent higher engine speed regions as the value of m increases and the rows PBKTIMm represent higher load regions as the value of m increases.

The KTIMn values stored in the areas enclosed by bold lines in FIG. 7, which are initially 1.0, can be updated. The KTIMn values in the other storage areas are all fixed values (1.0). In the following, the storage areas storing updatable learned correction coefficients KTIM are sometimes referred to as "updatable areas." As shown, the learned correction coefficient KTIM at a given engine speed NE is updatable if the manifold absolute pressure PBA is within a predetermined region at that engine speed NE. In other words, learned correction coefficient KTIM updating is limited to cases where the manifold absolute pressure PBA is within a certain range at a given engine speed NE.

The range of manifold absolute pressures PBA (the rows PBKTIMm) within which the learned correction coefficients KTIM are updatable varies with the value of the engine speed NE. Specifically, as the engine speed NE increases (the value of m of the column NKTIMm increases), the load range expands (the number of rows PBKTIMm increases) and shifts toward the high-load side (value of m of the row PBKTIMm increases).

Next, in S212 of the flowchart of FIG. 6, it is determined whether the storage area accessed in S210 is an updatable area. When the result in S212 is YES, the subroutine goes to S214, in which the learned correction coefficient KTIMn stored in the accessed updatable area is updated by overwriting it with the learned correction coefficient KTIM calculated in S208. When the result in S212 is NO, S214 is skipped.

Next, in S16 of the flowchart of FIG. 4, it is determined whether shift to lean-burn control is permissible. When the result in S12 is YES (i.e., when lean-burn control is being conducted), S14 is skipped.

Figure 8:
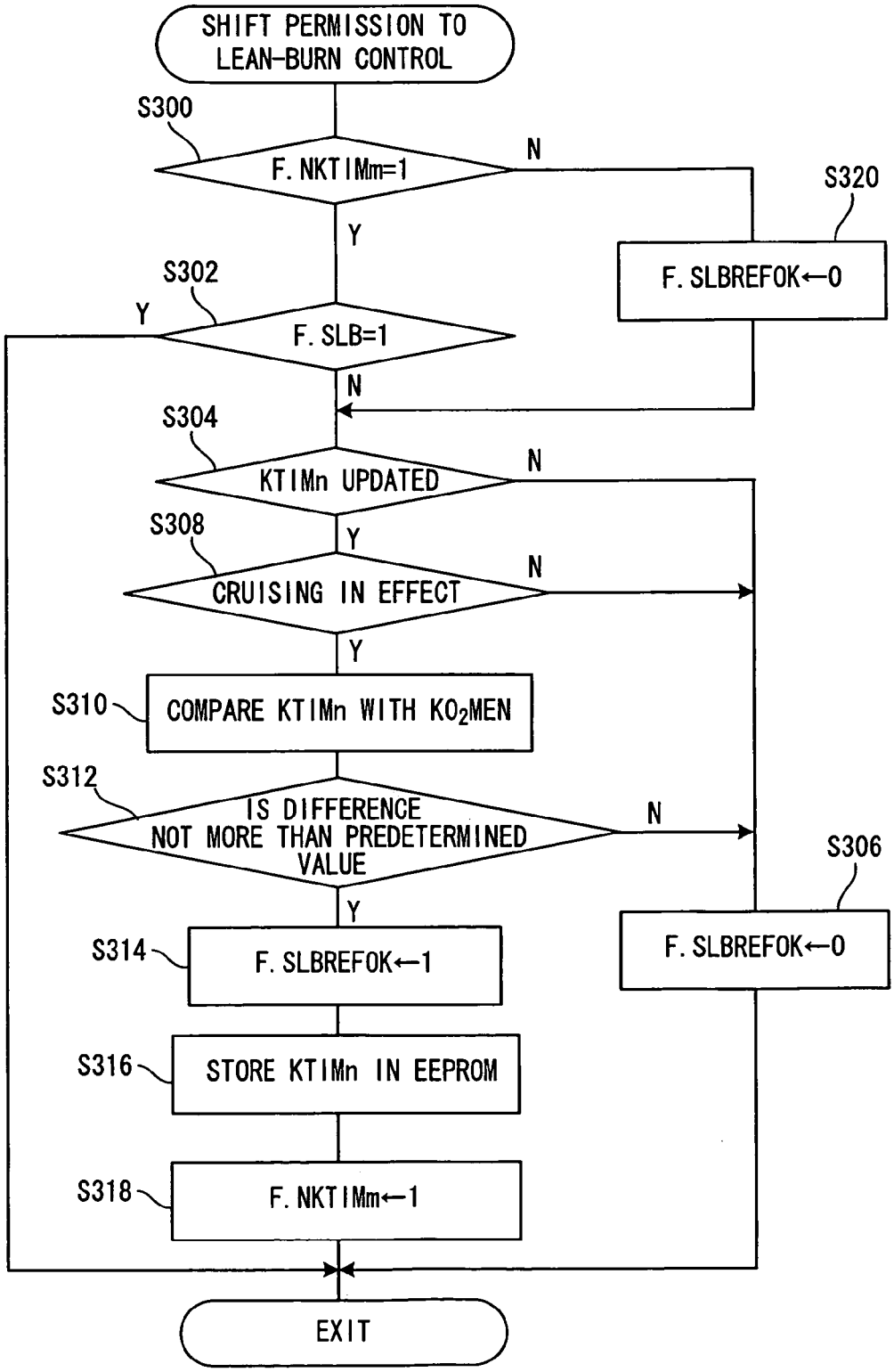
FIG 8 is a subroutine flowchart showing the processing conducted to determine whether shift to lean-burn control is permissible in the flowchart of FIG. 4.

FIG 8 is a subroutine flowchart showing the processing conducted to determine whether shift to lean-burn control is permissible.

First, in S300, it is determined whether the bit of a storage completed flag F.NKTIMm (m: integer between 1 and 8) whose initial value is 0 is set to 1. The meaning of the storage completed flag F.NKTIMm will be explained later.

When the result in S300 is YES, the subroutine goes to S302, in which it is determined whether the bit of the lean-burn in effect flag F.SLB is set to 1. When the result in S302 is YES, the remaining steps of the subroutine are skipped, and when it is NO, the program goes to S304.

In S304, it is determined whether the learned correction coefficient KTIMn (more exactly, the value stored in the storage area accessed using the current engine speed NE and manifold absolute pressure PBA; the same in the explanation regarding the flowchart of FIG. 8 that follows) was renewed by the processing S14 set out above. When the result in S304 is NO, the program goes to S306, in which the bit of the lean-burn control enabled flag F.SLBREFOK is reset to 0. In other words, shift to lean-burn control is prohibited.

When the result in S304 is YES, the subroutine goes to S308, in which it is determined whether cruising is in effect. The determination in S308 is conducted by determining whether the engine speed NE has stayed in the range of the same column NKTIMm for a predetermined time period. In other words, "cruising in effect" means "steady-state operation." The predetermined time period is clocked by a timer tmKTAREA (down counter). The value (predetermined time period) to which the timer tmKTAREA is set is made different for every column NKTIMm.

When the result in S308 is NO, the subroutine goes to S306, in which, shift to lean-burn control is prohibited. When the result in S308 is YES, the subroutine goes to S310, in which the learned correction coefficient KTIMn is compared with a feedback correction coefficient accumulated average value $KO_2MEN$ and then to S312, in which it is determined whether the difference between KTIMn and $KO_2MEN$ is equal to or less than (not more than) a predetermined value. $KO_2MEN$ here is an averaged value obtained by calculating the accumulated sum of the values of the feedback correction coefficient $KO_2$ at predetermined intervals (e.g, every 10 msec) during the period it takes the output of the $O_2$ sensor 50 to change from lean to rich and dividing the accumulated value by the number of summed values. The determinatioin made in S312 as to whether the difference between KTIMn and $KO_2MEN$ is equal to or less than (not more than) a predetermined value is for preventing occurrence of a difference between the environment when KTIMn was calculated (learned) and the current environment (more exactly, the environment at the time of execution of lean-burn control), i.e., to prevent KTIMn from becoming an inappropriate value.

When the result in S312 is NO, the subroutine goes to S306. When it is YES, the subroutine goes to S314, in which the bit of the lean-burn in effect flag F.SLB is set to 1. Next, in S316, the learned correction coefficient KTIMn is written to the stored value mapped data stored in the EEPROM 20*d*.

Figure 9:
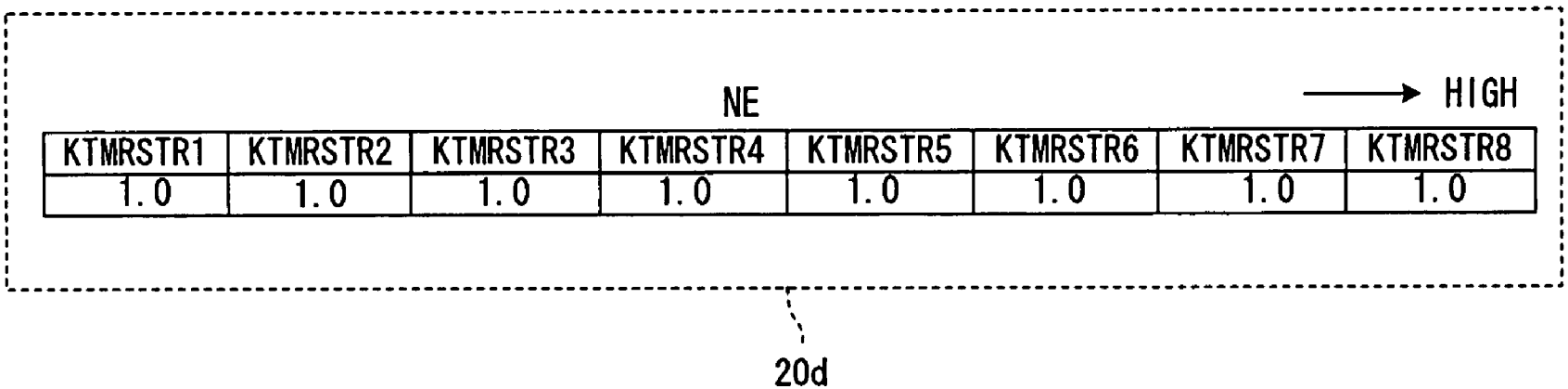
FIG 9 is an explanatory diagram showing a stored value mapped data used in the flowchart of FIG. 4.

FIG 9 is an explanatory diagram showing the stored value mapped data stored in the EEPROM 20*d*.

As shown in FIG. 9, the stored value mapped data is composed of multiple storage areas divided in accordance with the value of the engine speed NE. Specifically, it is composed of eight storage areas divided in correspondence to the columns NKTIMm of the learned correction coefficient mapped data and a learned correction coefficient KTIMn is stored in each of the storage areas. In the following, a learned correction coefficient KTIMn stored in the EEPROM 20*d* will sometimes be called a stored value KTMRSTRm (m: integer between 1 and 8).

In S316, the learned correction coefficient KTIMn is stored in the storage area of the EEPROM 20*d* as KTMRSTRm of the same m value as the column NKTIMm to which the updatable area storing the value concerned belongs (KTMRSTRm is updated).

Next, in S318, the bit of the storage completed flag F.NKTIMm (more exactly, F.NKTIMm of the same m value as the NKTIMm to which the stored learned correction coefficient KTIMn belongs) is set to 1. The fact that the bit of the storage completed flag F.NKTIMm is set to 1 means that stored value KTMRSTRm of the same m value has been stored (updated) in the EEPROM 20*d*.

When it is found in S300 that the bit of the storage completed flag F.NKTIMm is set to 1, i.e., that storage of the learned correction coefficient KTIMn in the EEPROM 20*d* has been completed, the result in this step is YES and the subroutine goes to S302. On the other hand, when the bit of the storage completed flag F.NKTIMm is 0, the result in S300 is NO and the subroutine goes to S320, in which the bit of the lean-burn control enabled flag F.SLBREFOK is reset to 0 (shift to lean-burn control is prohibited), whereafter S304 and the ensuing steps are executed.

The flowchart of FIG. 5 will be explained again.

First, in S100 of the flowchart of FIG. 5, it is determined whether the bit of the lean-burn control enabled flag F.SLBREFOK is set to 1, i.e., whether shift to lean-burn control is permissible. As mentioned earlier, the bit of the flag F.SLBREFOK is set to 1 at the same time as the learned correction coefficient KTIMn is stored in the EEPROM 20*d* (S314 and S316 of the flowchart of FIG. 8). Further, the learned correction coefficient KTIMn stored is the updated value calculated during execution of feedback control and stored in the RAM 20*c*. In other words, the determination made in S100 amounts to determining whether the learned correction coefficient KTIMn updated in the RAM 20*c* has been stored in the EEPROM 20*d*.

If the execution of the subroutine in progress is the first execution after shift to lean-burn control was enabled, the results in S100 and S106 are both YES, and the subroutine goes to S108. In S108, the learned correction coefficient mapped data stored in the RAM 20*c* is updated by overwriting it with the learned correction coefficient mapped data KTIMn stored in the EEPROM 20*d*, i.e., the stored value KTMRSTRm. Specifically, the stored value KTMRSTRm is written over all updatable areas belonging to the column NKTIMm of the same m value (i.e., the plurality of storage areas that can be accessed using the same engine speed). As a result, the updatable areas belonging to the same column NKTIMm come to share the same KTIMn value.

When the engine 14 is restarted, the stored value KTMRSTRm is written over the learned correction coefficient mapped data as the initial value of the learned correction coefficient KTIMn irrespective of the conditions specified in S100 and S106.

Next, the detected values of the engine speed NE and manifold absolute pressure PBA are used to retrieve the learned correction coefficient KTIM, the retrieved KTIM and other data are used to calculate the fuel injection quantity Tout, and the air/fuel ratio of the engine 14 is open-loop controlled to a desired air/fuel ratio leaner than the stoichiometric air/fuel ratio.

The lean-burn control set out in the foregoing will now be explained again with reference to FIG. 10 and ensuing drawings.

Figure 10:
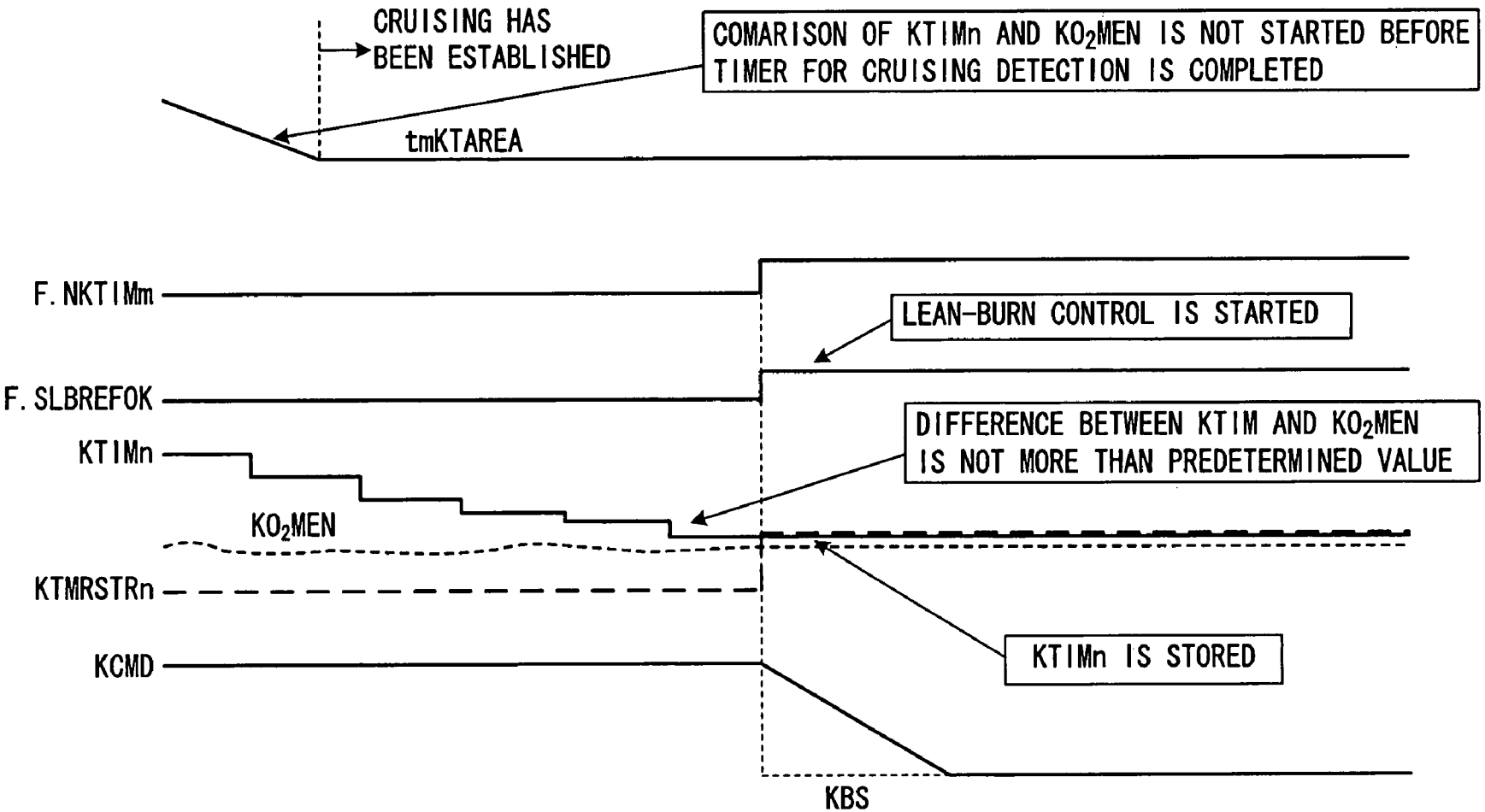
FIG 10 is a time chart showing the lean-burn control processing performed in accordance with the flowchart of FIG. 4.

FIG. 10 is a time chart showing the lean-burn control processing performed in accordance with the flowchart of FIG. 4. FIGS. 11 to 16 are explanatory diagrams showing learned correction coefficient mapped data, stored value mapped data and the like.

As shown in FIG. 10, when the manifold absolute pressure PBA exhibits a value within a predetermined range at a given engine speed NE, the value of the learned correction coefficient KTIMn is incrementally updated to make it approach the feedback correction coefficient accumulated average value $KO_2$MEN. The flowchart of FIG. 6 shows the processing at this time. An example of the learned correction coefficient mapped data being updated is shown in FIG. 11. As shown in FIG. 3, the operational region in which lean-burn control is performed is contained in the operational region in which feedback control is performed. Therefore, when the manifold absolute pressure PBA is within the predetermined range at a given engine speed NE and lean-burn control is not being performed, feedback control is implemented and updating of $KO_2$ and $KO_2$MEN is continued. The learned correction coefficient KTIMn can therefore be updated.

When the timer tmKTAREA has completed its countdown and the fact that cruising is in effect has been established, comparison of the updated learned correction coefficient KTIMn and $KO_2$MEN is started. When the difference therebetween is equal to or less than (not more than) the predetermined value, the value of the learned correction coefficient KTIMn that was being updated is stored in the EEPROM 20*d* as the stored value KTMRSTRm. At the same time, the bits of the flags F.SLBREFOK and F.NKTIMm are set to 1. The flowchart of FIG. 8 shows the processing at this time. Examples of the learned correction coefficient mapped data and stored value mapped data at this time are shown in FIG. 12. FIG. 12 shows that the value of the learned correction coefficient KTIM27 belonging to the column NKTIM4 was stored in the EEPROM 20*d* as the stored value KTMRSTR4. It also shows regarding the columns NKTIM1 and NKTIM2 that the learned correction coefficients KTIMn did not come to be stored in the EEPROM 20*d* as the stored values KTMRSTR1 and KTMRSTR2 (did not meet the conditions specified in S308 and S312).

The stored value KTMRSTRm stored in the EEPROM 20*d* is written over all updatable areas belonging to the column NKTIMm of the same m value, whereby all of the learned correction coefficients KTIMn stored in these areas are updated to the same value. In other words, all updatable areas that can be accessed using a given engine speed are overwritten with a single value (KTMRSTRm). Examples of the learned correction coefficient mapped data and stored value mapped data at this time are shown in FIG. 13. As shown in FIG. 13, the value of the stored value KTMRSTR4 is reflected in all of the updatable areas belonging to the column NKTIM4, namely, in KTIM19, KTIM27 and KTIM35.

The learned correction coefficient KTIM can be retrieved from the learned correction coefficient mapped data updated in the foregoing manner using NE and PBA as address data.

Figure 14:
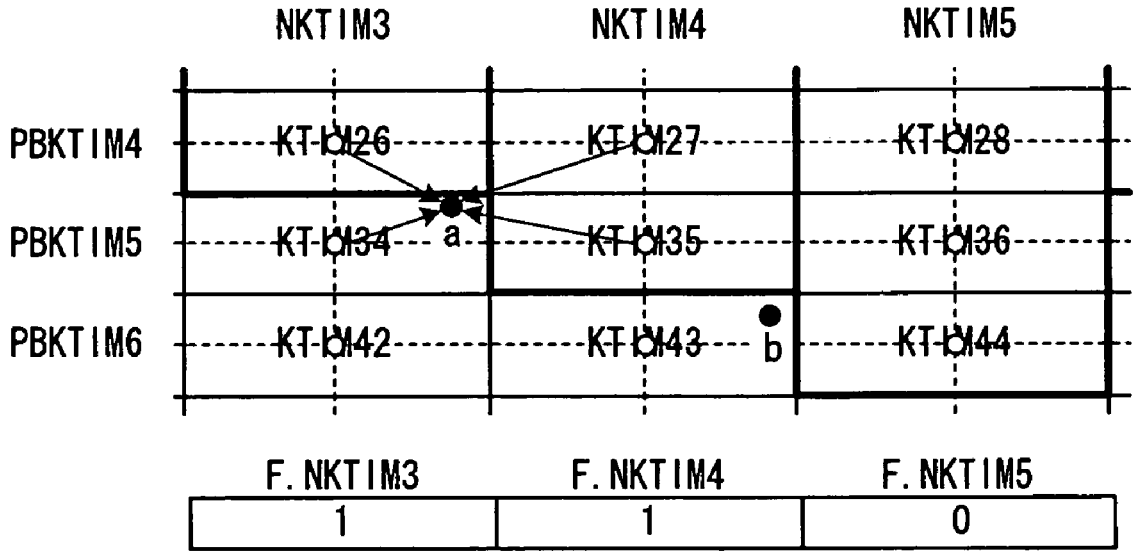
FIG 14 is an explanatory diagram showing part of a learned correction coefficient mapped data shown in FIG. 11 etc.

FIG. 14 is an explanatory diagram showing part of a learned correction coefficient mapped data.

Retrieval of the learned correction coefficient KTIM will be explained with reference to FIG. 14. As explained earlier, the learned correction coefficient mapped data is divided into 8 columns NKTIMm each associated with a different range of engine speeds NE and into 8 rows PBKTIMm each associated with a different range of manifold absolute pressures PBA. The engine speed ranges of the columns NKTIMm are, for example, 1,500 to 2,000 rpm for the column NKTIM3 and 2,000 to 2,500 rpm for the column NKTIM4. The manifold absolute pressure ranges of the rows are similarly defined.

The learned correction coefficient KTIM is determined by linear interpolation, specifically by four-point interpolation. For example, in the case where the retrieval point determined using the engine speed NE and manifold absolute pressure PBA is the point a in FIG. 14, four-point interpolation is performed using KTIM26, KTIM27, KTIM34 and KTIM35 stored in the four storage areas neighboring (or including) the point a and the so-obtained value is defined as the retrieved value of the learned correction coefficient KTIM. However, in the case of a retrieval point such as point b whose four learned correction coefficients KTIMn to be used in the four-point interpolation include one or more un-updated values (in the example of FIG. 14, the bit of the flag F.NKTIM5 is 0, meaning that KTIM28, KTIM36 and KTIM44 belonging to the column NKTIM5 are un-updated), the four-point interpolation is not performed and the value of the storage area including the point b, namely KTIM43, is defined as the retrieved value.

The retrieved learned correction coefficient KTIM is used together with the other correction terms and the desired equivalence ratio KCMD to correct the basic fuel injection quantity Ti, thereby calculating the fuel injection quantity Tout for lean-burn control. As shown in FIG. 10, the desired equivalence ratio KCMD is incrementally changed toward the desired convergence value KBS (value on the lean side). FIG. 5 shows the processing at this time.

Further, as shown in FIG. 15, during lean-burn control, at the time of shifting to a column for which the bit of the storage completed flag F.NKTIMm is not set to 1 (FIG. 15 shows an example of shifting from the column NKTIM4 to the column NKTIM5), the bit of the flag F.SLBREFOK is reset to 0 in S300 and S320 of the flowchart of FIG. 8. As a result, feedback control is performed instead of lean-burn control and the learned correction coefficient KTIMn belonging to column NKTIM5 is updated.

Next, processing similar to the foregoing is performed to store the learned correction coefficient KTIMn in the EEPROM 20*d* as the stored value KTMRSTR5, whereupon the bits of the flags F.SLBREFOK and F.NKTIMm are set to 1 (see FIG. 16). Then, once the value of KTMRSTR5 has been written over all of KTIM20, KTIM28, KTIM36 and KTIM44 belonging to the column NKTIM5, lean-burn control is implemented. Thus lean-burn control is conducted only when the value of the learned correction coefficient KTIMn to be used has been updated.

As set out in the foregoing, the air/fuel ratio control system for an outboard motor engine according to the foregoing embodiment of the invention is configured to update the learned correction coefficient KTIMn used in open-loop control (lean-burn control) only when the manifold absolute pressure PBA (engine load) is within a predetermine range relative to the engine speed NE concerned. As a result, the air/fuel ratio can be accurately controlled to one other than the stoichiometric air/fuel ratio even when an $O_2$ sensor is used.

To be more concrete, unlike an engine used in a four-wheeled vehicle or the like, an engine incorporated in an outboard motor is limited to a certain range of engine loads during steady-state operation. Therefore, by limiting the updating of the learned correction coefficient KTIMn to when the manifold absolute pressure PBA at the engine speed NE concerned is within a predetermined range (i.e., to during steady-state operation, namely cruising), it is possible to eliminate causes, such as transient operation, that disturb the value of the learned correction coefficient, thereby enabling the learned correction coefficient to be set to the optimal value. As a result, it becomes possible to accurately control the air/fuel ratio to one other than the stoichiometric air/fuel ratio even when using an $O_2$ sensor that is of lower cost than a universal sensor.

The foregoing embodiment is further configured to overwrite the learned correction coefficients KTIMn stored in those of the plurality of (64) storage areas provided in the RAM 20*c* that fall in the same column NKTIMm (i.e., the learned correction coefficients KTIMn accessible by the same engine speed) with a single value stored in the EEPROM 20*d* (stored value KTMRSTRm), i.e., to make the value of learned correction coefficient KTIMn common among the storage areas that can be accessed using the same engine speed NE. As a result, the number of learned correction coefficients required to be stored in the EEPROM 20*d* can be minimized, so that the required capacity of the EEPROM 20*d* can be minimized. The basic fuel injection quantity Ti increases and decreases linearly as the engine load (manifold absolute pressure PBA) changes. Therefore, when the engine speed is constant, the learned correction coefficient hardly varies even if the engine load changes. As a result, the sharing of a common learned correction coefficient within the same column does not cause any practical problems.

Moreover, the foregoing embodiment is configured to conduct open-loop control only when the learned correction coefficient KTIMn used to correct the basic fuel injection quantity Ti has been updated. As a result, the air/fuel ratio can be still more accurately controlled because the best learned correction coefficient can always be used in the air/fuel ratio control.

In addition, the foregoing embodiment is configured to conduct open-loop control only when the difference between the feedback correction coefficient (specifically, $KO_2MEN$) and the updated learned correction coefficient KTIMn is equal to or less than a predetermined value. As a result, the air/fuel ratio control can be prevented from being conducted using a learned correction coefficient calculated immediately after engine starting when the output of the $O_2$ sensor 50 is unstable. The air/fuel ratio can therefore be still more accurately controlled.

Furthermore, the foregoing embodiment is configured so that when the engine 14 is restarted the learned correction coefficient KTIMn stored in the EEPROM 20*d* (stored value KTMRSTRm) is written over the learned correction coefficient mapped data in the RAM 20*c* as the initial value of the learned correction coefficient KTIMn. As a result, the learned correction coefficient calculated when the engine 14 was previously started can be used when it is restarted, so that the air/fuel ratio can be quickly and accurately controlled to one other than the stoichiometric air/fuel ratio.

The embodiment is thus configured to have a system for controlling an air/fuel ratio of an internal combustion engine (14) mounted on an outboard motor (10), comprising: detectors (crankangle sensor 44, manifold absolute pressure sensor 34, ECU 20) detecting operational state of the engine including an engine speed (NE) and engine load (manifold absolute pressure PBA; an oxygen sensor ($O_2$ sensor 50)) disposed at an exhaust system of the engine and producing an output whose property changes near a stoichiometric air/fuel ratio; a first controller (ECU 20) controlling the air/fuel ratio of the engine to the stoichiometric air/fuel ratio by correcting a basic fuel injection quantity (Ti) to be supplied to the engine determined based on the detected operational state of the engine, by a feedback correction coefficient ($KO_2$) determined based on the output of the oxygen sensor; a memory (RAM 20*c*) having a plurality of storage areas divided by the engine speed and engine load and each storing a learned correction coefficient (KTIMn) that is used for correcting the basic fuel injection quantity; a learned correction coefficient calculator (ECU 20, S208) calculating the learned correction coefficient based on the feedback correction coefficient; a learned correction coefficient updater (ECU 20, S210, S212, S214, S316, S108) updating the leaned correction coefficient by writing the calculated learned correction coefficient over the stored learned correction coefficient, when the engine load is within a predetermined range relative to the engine speed; and a second controller (ECU 20, S110 to S114) retrieving the learned correction coefficient from the engine speed and engine load and controlling the air/fuel ratio to one other than the stoichiometric air/fuel ratio, i.e., conducts lean-burn control by correcting the basic fuel injection quantity by at least the retrieved learned correction coefficient.

In the system, the second controller controls the air/fuel ratio to the one other than the stoichiometric air/fuel ratio, when the learned correction coefficient has been updated (S300, S320, S100).

In the system, the second controller controls the air/fuel ratio to the one other than the stoichiometric air/fuel ratio, when a difference between the feedback correction coefficient and the updated learned correction coefficient is equal to or less than a predetermined value (S312, S306, S100).

The system further includes: a nonvolatile memory (EEPROM 20*d*) storing the calculated learned correction coefficient; and the learned correction coefficient updater retrieves the calculated learned correction coefficient stored in the nonvolatile memory (KTMRSTRm) and updates the leaned correction coefficient stored at one of the storage areas of a same engine speed as the retrieved calculated learned correction coefficient (the same m value as the column NKTIMm), by overwriting with the calculated learned correction coefficient (S108).

In the system, the learned correction coefficient updater writes the calculated learned correction coefficient over the learned correction coefficient stored at the one of the storage areas, as an initial value, when the engine is restarted.

In the foregoing explanation, the learned correction coefficient KTIMn is used in lean-burn control but it can also be used in open-loop control during high-load operation.

In the foregoing explanation, the learned correction coefficient KTIMn is stored in the EEPROM 20*d* but it can instead be stored any of various other kinds of nonvolatile memory media.

Japanese Patent Application Nos. 2005-042861 and 2005-042862 both filed on Feb. 18, 2005, are incorporated herein in their entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling an air/fuel ratio of an internal combustion engine mounted on an outboard motor, comprising:

detectors detecting operational state of the engine including an engine speed and engine load;

an oxygen sensor disposed at an exhaust system of the engine and producing an output whose property changes near a stoichiometric air/fuel ratio;

a first controller controlling the air/fuel ratio of the engine to the stoichiometric air/fuel ratio by correcting a basic fuel injection quantity to be supplied to the engine determined based on the detected operational state of the engine, by a feedback correction coefficient determined based on the output of the oxygen sensor;

a memory having a plurality of storage areas divided by the engine speed and engine load and each storing a learned correction coefficient that is used for correcting the basic fuel injection quantity;

a learned correction coefficient calculator calculating the learned correction coefficient based on the feedback correction coefficient;

a learned correction coefficient updater updating the learned correction coefficient by writing the calculated learned correction coefficient over the stored learned correction coefficient, when the engine load is within a predetermined range relative to the engine speed; and a second controller retrieving the learned correction coefficient from the engine speed and engine load and controlling the air/fuel ratio to one other than the stoichiometric air/fuel ratio by correcting the basic fuel injection quantity by at least the retrieved learned correction coefficient.

2. The system according to claim 1, wherein the second controller controls the air/fuel ratio to the one other than the stoichiometric air/fuel ratio, when the learned correction coefficient has been updated.

3. The system according to claim 2, wherein the second controller controls the air/fuel ratio to the one other than the stoichiometric air/fuel ratio, when a difference between the feedback correction coefficient and the updated learned correction coefficient is equal to or less than a predetermined value.

4. The system according to claim 1, further including:

a nonvolatile memory storing the calculated learned correction coefficient;

and the learned correction coefficient updater retrieves the calculated learned correction coefficient stored in the nonvolatile memory and updates the learned correction coefficient stored at one of the storage areas of a same engine speed as the retrieved calculated learned correction coefficient, by overwriting with the calculated learned correction coefficient.

5. The system according to claim 4, wherein the learned correction coefficient updater writes the calculated learned correction coefficient over the learned correction coefficient stored at the one of the storage areas, as an initial value, when the engine is restarted.

6. A method of controlling an air/fuel ratio of an internal combustion engine mounted on an outboard motor, comprising steps of:

(a) detecting operational state of the engine including an engine speed and engine load;

(b) controlling the air/fuel ratio of the engine to the stoichiometric air/fuel ratio by correcting a basic fuel injection quantity to be supplied to the engine determined based on the detected operational state of the engine, by a feedback correction coefficient determined based on an output of an oxygen sensor disposed at an exhaust system of the engine and producing the output whose property changes near a stoichiometric air/fuel ratio;

(c) preparing a memory having a plurality of storage areas divided by the engine speed and engine load and each storing a learned correction coefficient that is used for correcting the basic fuel injection quantity;

(d) calculating the learned correction coefficient based on the feedback correction coefficient;

(e) updating the learned correction coefficient by writing the calculated learned correction coefficient over the stored learned correction coefficient, when the engine load is within a predetermined range relative to the engine speed; and (f) retrieving the learned correction coefficient from the engine speed and engine load and controlling the air/fuel ratio to one other than the stoichiometric air/fuel ratio by correcting the basic fuel injection quantity by at least the retrieved learned correction coefficient.

7. The method according to claim 6, wherein the step (f) controls the air/fuel ratio to the one other than the stoichiometric air/fuel ratio, when the learned correction coefficient has been updated.

8. The method according to claim 7, wherein the step (f) controls the air/fuel ratio to the one other than the stoichiometric air/fuel ratio, when a difference between the feedback correction coefficient and the updated learned correction coefficient is equal to or less than a predetermined value.

9. The method according to claim 6, further including the step of:

(g) preparing a nonvolatile memory storing the calculated learned correction coefficient;

and the step (e) retrieves the calculated learned correction coefficient stored in the nonvolatile memory and updates the learned correction coefficient stored at one of the storage areas of a same engine speed as the retrieved calculated learned correction coefficient, by overwriting with the calculated learned correction coefficient.

10. The method according to claim 9, wherein the step (e) writes the calculated learned correction coefficient over the learned correction coefficient stored at the one of the storage areas, as an initial value, when the engine is restarted.

* * * * *